US011560755B1

(12) United States Patent
Kuzmin

(10) Patent No.: US 11,560,755 B1
(45) Date of Patent: Jan. 24, 2023

(54) LADDER MOVING MECHANISM

(71) Applicant: Yakov I. Kuzmin, Homer, AK (US)

(72) Inventor: Yakov I. Kuzmin, Homer, AK (US)

( * ) Notice: Subject to any disclaimer, the term of this patent is extended or adjusted under 35 U.S.C. 154(b) by 478 days.

(21) Appl. No.: 16/742,990

(22) Filed: Jan. 15, 2020

(51) Int. Cl.
*E06C 1/397* (2006.01)
*E06C 1/39* (2006.01)

(52) U.S. Cl.
CPC ..... *E06C 1/397* (2013.01); *E06C 1/39* (2013.01)

(58) Field of Classification Search
CPC ..... E06C 1/397; E06C 1/39; B62B 3/00
USPC ..... 182/12, 13, 16
See application file for complete search history.

(56) References Cited

U.S. PATENT DOCUMENTS 1,972,367 A 9/1934 Willard
2,521,114 A 9/1950 Campbell
2,798,652 A 7/1957 Easton
3,256,954 A * 6/1966 Warthen ..... E04G 5/00 182/16
3,429,398 A * 2/1969 Payne ..... E04G 1/28 182/16
3,520,382 A * 7/1970 Halsey ..... E04G 5/02 182/16
4,088,202 A * 5/1978 Costello ..... E04G 1/28 180/65.6
4,967,733 A * 11/1990 Rousseau ..... B66F 11/04 182/69.6
5,653,307 A 8/1997 Kerr
5,722,506 A * 3/1998 Takai ..... E04G 1/24 182/16
6,688,426 B1 * 2/2004 Mikros ..... E06C 1/397 182/15
6,929,093 B1 * 8/2005 Land ..... E06C 1/397 182/16
7,753,169 B1 7/2010 Kurtz
8,186,481 B2 5/2012 Moss et al.
8,434,592 B1 * 5/2013 Young ..... E04G 1/24 182/12
8,593,265 B1 * 11/2013 Dornfeld ..... G08C 17/00 182/127
2001/0030080 A1 * 10/2001 Chick ..... E04G 5/00 182/16
2002/0112918 A1 * 8/2002 Frketic ..... E06C 1/397 182/16
2005/0029048 A1 * 2/2005 Frame ..... E06C 1/39 182/152
2006/0225954 A1 10/2006 Sayles
2008/0093166 A1 4/2008 Frolik et al.
(Continued)

FOREIGN PATENT DOCUMENTS

EP 0378801 A1 7/1990
KR 101013194 B1 * 2/2011

OTHER PUBLICATIONS

Rolling ladder Patent Translation [online]. Google Patents [retrieved on Mar. 13, 2019]. Retrieved from the Internet: <URL: https://patents.google.com/patent/EP0378801A1/en?q=rolling&q=ladder&oq=rolling+ladder>.

*Primary Examiner* — Jose V Chen
(74) *Attorney, Agent, or Firm* — Cramer Patent & Design, PLLC; Aaron R. Cramer

(57) ABSTRACT

A ladder moving device utilizes an A-frame ladder with a plurality of wheels disposed under each leg, each of which are in mechanical communication to a hand crank. The hand crank is disposed adjacent the upper end of the ladder. Each wheel has a locking mechanism.

10 Claims, 5 Drawing Sheets

(56) References Cited

U.S. PATENT DOCUMENTS

| | | | | |
|---|---|---|---|---|
| 2009/0173576 | A1* | 7/2009 | Rosenthal | E06C 7/14 182/116 |
| 2017/0167196 | A1* | 6/2017 | Johnson | E06C 1/397 |
| 2020/0141184 | A1* | 5/2020 | Liu | E06C 1/383 |
| 2021/0062580 | A1* | 3/2021 | Smith | E04G 1/20 |
| 2022/0018189 | A1* | 1/2022 | Coulter | E06C 7/44 |

* cited by examiner

LADDER MOVING MECHANISM

RELATED APPLICATIONS

None.

FIELD OF THE INVENTION

The present invention relates generally to a ladder moving mechanism.

BACKGROUND OF THE INVENTION

Ask anyone who spends their day working at an elevated work location what their worst part of their job is and they will usually comment upon the constant travel up and down step ladders. This is especially prevalent while painting or while performing drywall work, electrical work, plumbing work or the like.

Most of this travel during these operations is to simply perform a small task such as routing wire or cable through a hole and then descend the step ladder, move it, reclimb the step ladder, and repeat the same task over and over again. Such travel not only negatively impacts working time and energy levels, but also reduces jobs safety due to the constant movement on the step ladder. Accordingly, there exists a need for a means by which time spent descending step ladders, moving step ladders, and reclimbing step ladders moving mechanism fulfills this need.

SUMMARY OF THE INVENTION

The principles of the present invention provide for a stepladder, comprises a plurality of front side rails which are provided with a plurality of evenly spaced mounting holes along an outward facing surface which allow for mounting a movable work surface, a pair of spreaders which are operated with a folding brace of a crank assembly to allow the front side rails and a plurality of rear side rails to fold together along a second travel path using a pair of hinge points in a top cap, a pair of crank handles which are provided to allow a user to crank which in turn causes the stepladder to move forward or backward while standing on one of a plurality of steps, a bridging shaft which is common to both sides of the crank assembly and is provided with a center-mounted slip coupling that allows the crank handles to be rotated independently and a set of two horizontal drive chains, a pair of brake levers which are provided to engage the upper drive sprockets and prevent rotation, a brake mechanism which creates friction against the upper drive sprockets when the brake lever is moved along a third travel path, and an axle pin which is driven through one side of the mounting bracket into a wheel bearing of a wheel, into another wheel bearing, through the remaining mounting bracket, into a sprocket bearing and finally into the lower drive sprocket.

The movable work surface may be secured with a plurality of spring-loaded pins which allow the movable work surface to be removed for storage. The movable work surface may be reinstalled anywhere along the front side rails to provide for placement as needed for a task being performed with the stepladder. The movable work surface may be positioned near the top of the stepladder when performing tasks at an elevated location and may be positioned near a middle portion or a lower portion of the stepladder when performing tasks at grade or a slight elevation above grade. The bottom of each of the front side rails and the rear side rails may be provided with a roller assembly. The roller assembly may include a wheel, a mounting bracket, and a lower drive sprocket. The lower drive sprockets may be connected to a respective upper drive sprocket by an individual vertical drive chain. The crank assembly may provide a plurality of dual main drive sprockets.

A first crank handle of the pair of crank handles may crank clockwise and a second crank handle of the pair of crank handles counterclockwise. The crank handles may include a 90° coupling to allow the crank handles to fold along a first travel path for space saving ability. A rotational force imparted to the crank handles by the user may be transferred to the upper drive sprockets by the horizontal drive chains, then to the lower drive sprockets of each roller assemblies by the vertical drive chains. The crank handles on either side of the stepladder, along a crank travel path, allowing the user to affect motion of the stepladder. The stepladder moves forward in a straight manner when turning both of the crank handles forward in an equal manner. The stepladder will move backwards in a straight manner by turning both of the crank handles backward in an equal manner.

By turning only one of the crank handles, the stepladder will make a corresponding hard turn based upon which crank handle the rotational force may be imparted to and by turning each of the crank handles in a differential manner, the stepladder will make motion along corresponding differential arcing travel path.

The axle pin may be held in place by a restraining means selected from the group consisting of a cap, a nut, or a forged dome. The upper drive sprockets on the front side rails are directly coupled with the upper drive sprockets on the rear side rails, the roller assemblies on the rear side rails may be prevented from rotation. The stepladder may be made of material selected from the group consisting of wood, aluminum, or fiberglass and may be moved in a circle to allow the stepladder to move in an arced travel path and a linear travel path.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
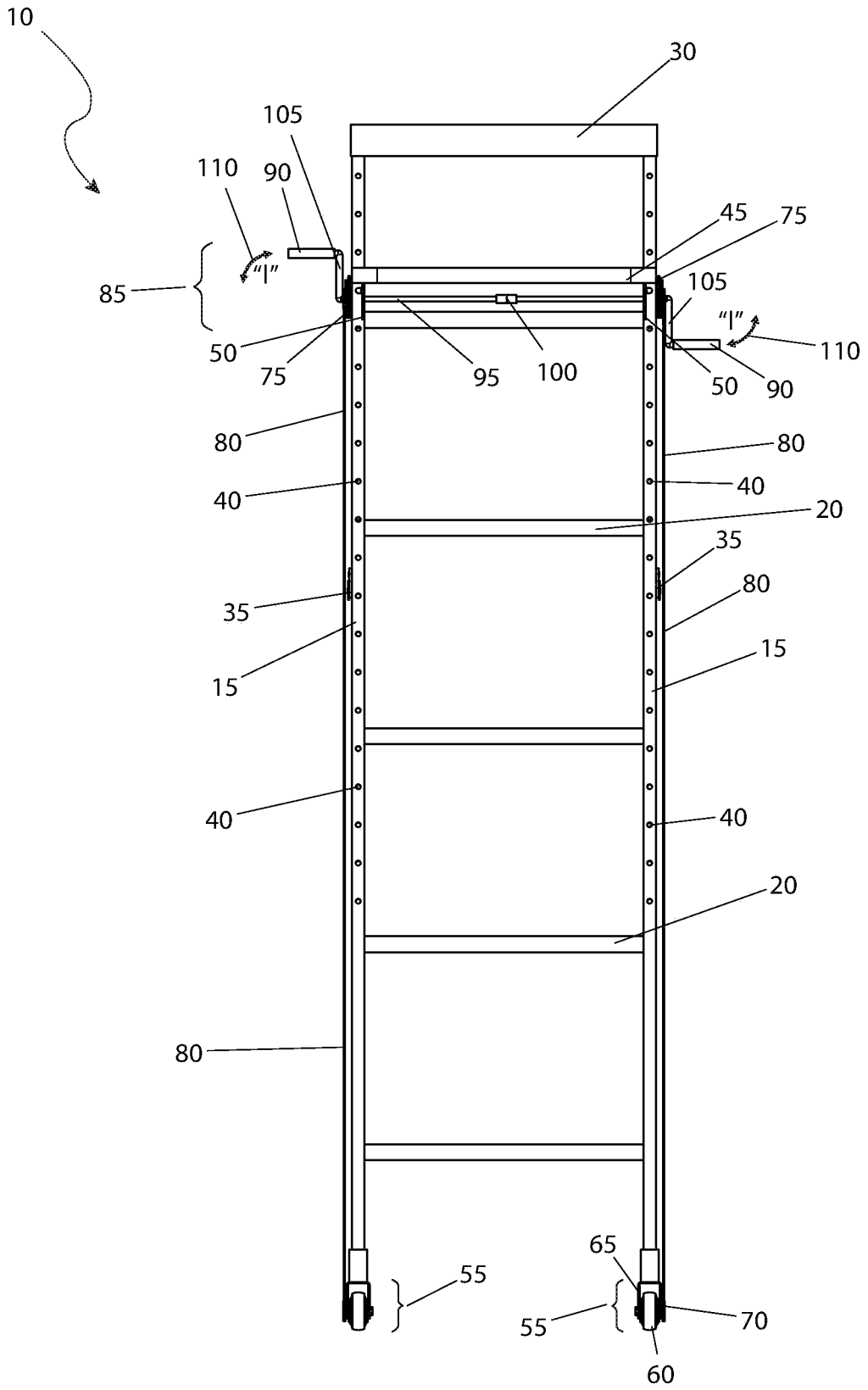
FIG. 1 is a front view of the stepladder 10, according to the preferred embodiment of the present invention.

10 stepladder
15 front side rail
20 step
25 rear side rail
30 top cap
35 spreader

40 mounting hole
45 movable work surface
50 spring loaded pin
55 roller assembly
60 wheel
65 mounting bracket
70 lower drive sprocket
75 upper drive sprocket
80 vertical drive chain
85 crank assembly
90 crank handle
95 bridging shaft
100 slip coupling
105 ninety degree (90°) coupling
110 first travel path "1"
115 folding brace
120 second travel path "2"
125 hinge points
130 dual main drive sprocket
135 horizontal drive chain
140 brake lever
145 brake mechanism
150 third travel path "3"
155 crank travel path "c"
160 arcing travel path "a"
165 axle pin
170 wheel bearing
175 sprocket bearing
180 restraining means
185 inner face of upper drive socket
190 outer face of upper drive socket
195 common shaft
200 hinge bracket

DESCRIPTION OF THE PREFERRED EMBODIMENTS

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a front view of the stepladder 10, according to the preferred embodiment of the present invention is disclosed. The stepladder 10, includes multiple parts as found on a conventional step ladder, including but not limited to: front side rails 15, step(s) 20, rear side rails 25, a top cap 30, and spreaders 35. Possible materials of construction include wood, aluminum, or fiberglass. The overall height of the stepladder 10 is not limited by the teachings of the present invention. As such, the materials of construction and the overall size and configuration of the stepladder 10 is not intended to be a limiting factor of the present invention.

The front side rails 15 are provided with a plurality of evenly spaced mounting holes 40 along its outward facing surface which allow for a mounting of a movable work surface 45. The movable work surface 45 is secured with spring loaded pins 50, which when removed, allow the movable work surface 45 to be removed for purposes of storage. As such, the movable work surface 45 may be reinstalled anywhere along the front side rails 15 to provide for placement as needed for the task being performed with the stepladder 10. It is envisioned that the movable work surface 45 would be positioned near the top of the stepladder 10 when performing tasks at an elevated location and would positioned near the middle or lower portion of the stepladder 10 when performing tasks at grade or a slight elevation above grade. The bottom of each of the front side rails 15 and the rear side rails 25 is provided with a roller assemblies 55, including a wheel 60, a mounting bracket 65, and a lower drive sprocket 70. Each of the four (4) lower drive sprockets 70 are connected to a respective upper drive sprocket 75 by an individual vertical drive chain 80. The upper drive sprockets 75 are part of a crank assembly 85 which will be described in greater detail herein below. It is envisioned that the movable work surface 45 is capable of supporting and retaining a myriad of supplies commonly associated with working on a ladder, such as means for supporting and retaining in paint can, brushes, tape measures, long-handled had tools, and the like.

Two (2) crank handles 90 is provided to allow a user, while standing on a step 20, to crank, either clockwise or counterclockwise, to cause the stepladder 10 to move forward or backward. A bridging shaft 95, common to both sides of the crank assembly 85 is provided with a center-mounted slip coupling 100. The slip coupling 100 allows the crank handles 90 to be rotated independently (a first crank handle 90 clockwise, and a second crank handle 90 counterclockwise). In such a manner, the stepladder 10 can be moved in a circle to allow the stepladder 10 to move in an arced travel path as well as a linear travel path. Both of the crank handles 90 are proved with a ninety degree (90°) coupling 105 to allow the crank handles 90 to fold along a first travel path "1" 110 for space saving ability.

Figure 2:
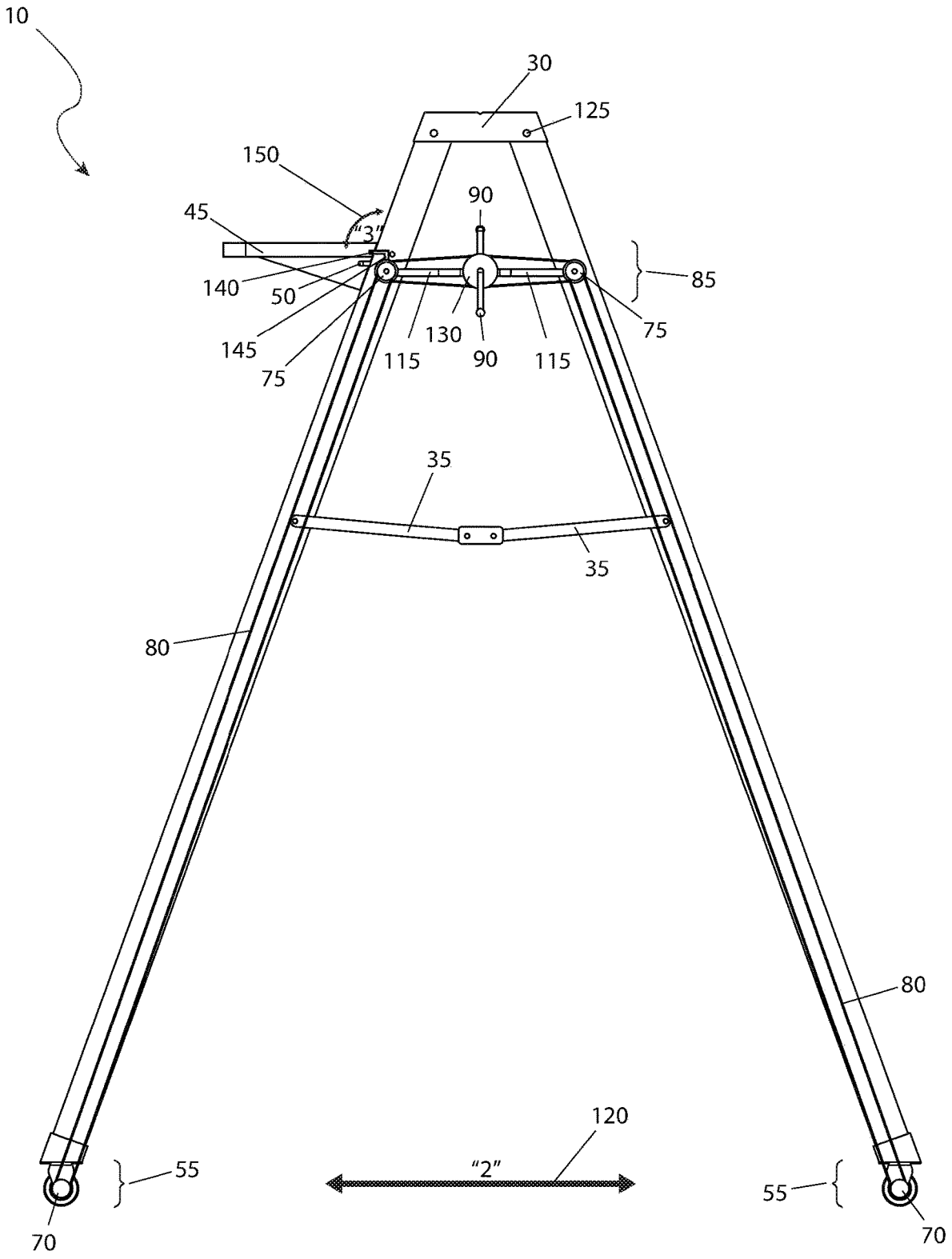
FIG. 2 is a side view of the stepladder 10, according to the preferred embodiment of the present invention.

Referring next to FIG. 2, a side view of the stepladder 10, according to the preferred embodiment of the present invention is depicted. The spreaders 35 are readily visible and operate in a conventional manner. The spreaders 35 operate with a folding brace 115 of the crank assembly 85 to allow the front side rails 15 and the rear side rails 25 to fold together along a second travel path "2" 120 using two (2) hinge points 125 (of which only one (1) is shown due to illustrative limitations) located in the top cap 30. One (1) of the two (2) spring loaded pins 50 are visible shown locking the movable work surface 45 to the front side rails 15 at the desired location. The crank assembly 85 provides a dual main drive sprockets 130 (one (1) per a total of two (2) upon which a crank handle 90 is fastened). A set of two (2) horizontal drive chains 135 (two (2) per side for a total of four (4) mechanically couple the dual main drive sprockets 130 to each of the four (4) upper drive sprockets 75). In such a manner, the rotational force imparted to the crank handles 90 by the user is transferred to the upper drive sprockets 75 by the horizontal drive chains 135; then to the lower drive sprockets 70 of each roller assemblies 55 by the vertical drive chains 80. Two (2) brake levers 140 (one (1) per each upper drive sprocket 75 on each front side rails 15) are provided to engage the upper drive sprockets 75 and prevent rotation. A brake mechanism 145 creates friction against the upper drive sprockets 75 when the brake lever 140 is moved along a third travel path "3" 150. As the upper drive sprockets 75 on the front side rails 15 are directly coupled with the upper drive sprockets 75 on the rear side rails 25, the roller assemblies 55 on the rear side rails 25 are prevented from rotation as well. The functionality of the brake mechanism 145 is viewed as a means of improving safety when the stepladder 10 is stationary.

Figure 3:
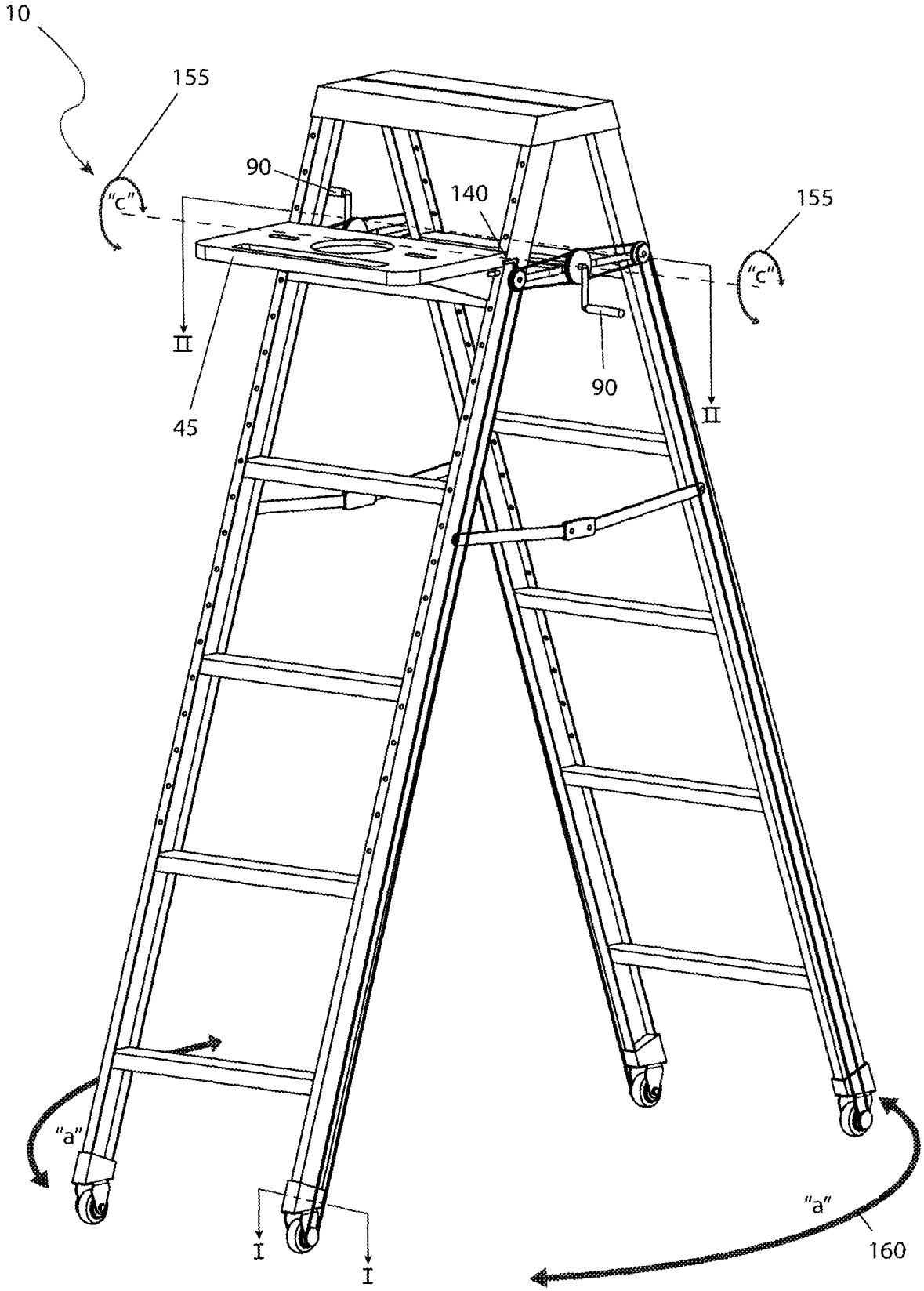
FIG. 3 is a perspective view of the stepladder 10, according to the preferred embodiment of the present invention.

Referring now to FIG. 3, a perspective view of the stepladder 10, according to the preferred embodiment of the present invention is shown. By manipulation of the crank handles 90 on either side of the stepladder 10, along a crank travel path "c" 155, the user may affect motion of the stepladder 10 in the following manner: by turning both crank handles 90 forward in an equal manner, the stepladder 10 will move forward in a straight manner; by turning both crank handles 90 backward in an equal manner, the stepladder 10 will backwards in a straight manner; by turning only one (1) crank handle 90, the stepladder 10 will make a corresponding hard turn based upon which crank handle 90 the rotational force is imparted to; by turning each crank handles 90 in a differential manner, the stepladder 10 will make motion along corresponding differential arcing travel path "a" 160.

Figure 4:
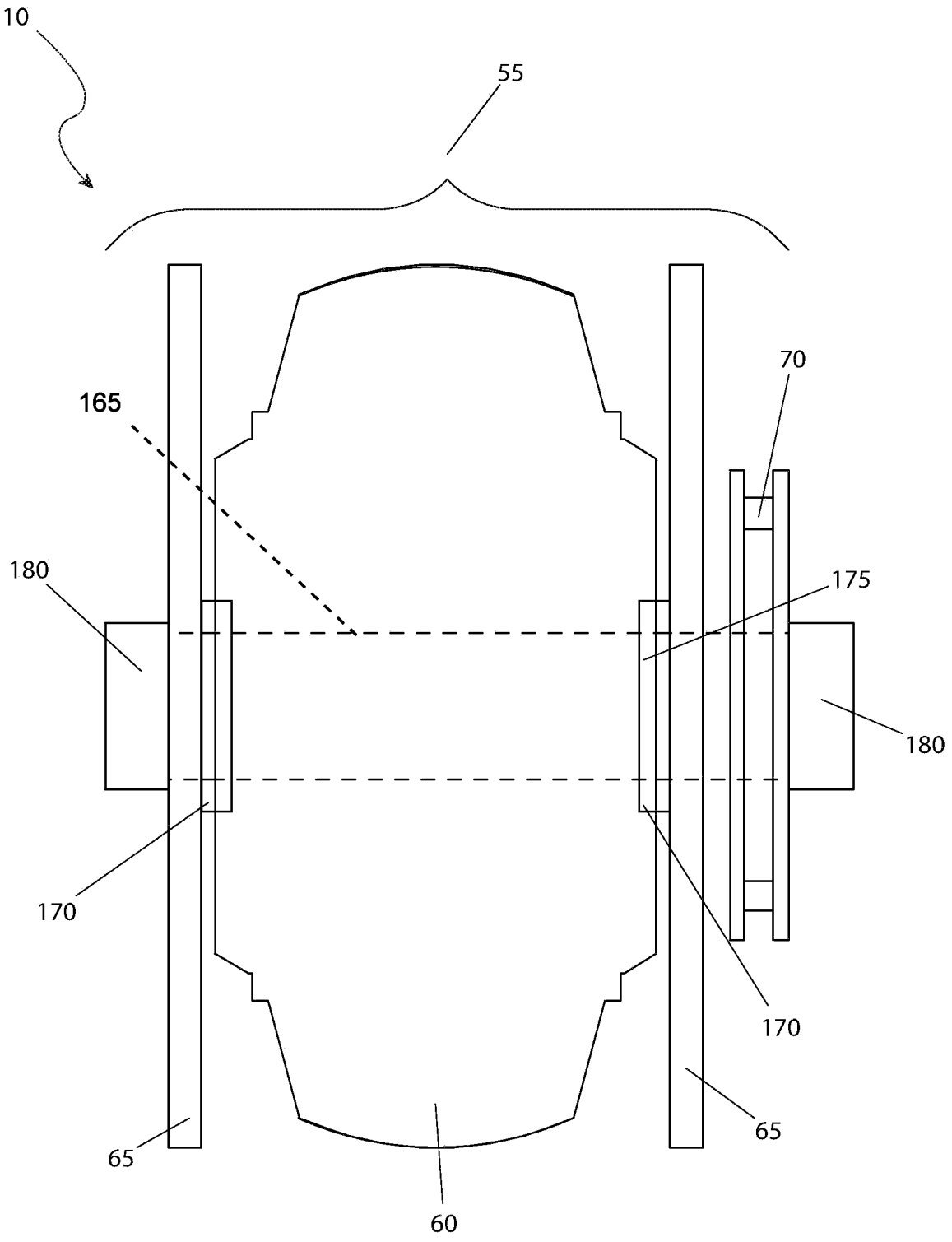
FIG. 4 is a sectional view of the stepladder 10, as seen along a line I-I, as shown in FIG. 3, according to the preferred embodiment of the present invention.

Referring next to FIG. 4, a sectional view of the stepladder 10, as seen along a line I-I, as shown in FIG. 3, according to the preferred embodiment of the present invention is disclosed. It is noted that FIG. 4 is typical for each of the four (4) roller assemblies 55. An axle pin 165 is driven through one (1) side of the mounting bracket 65, into a wheel bearing 170, into the wheel 60, into another wheel bearing 170, through the remaining mounting bracket 65, into a sprocket bearing 175 and finally into the lower drive sprocket 70. The axle pin 165 is held in place by a restraining means 180 such as a cap, nut, forged dome (as shown) or the like.

Figure 5:
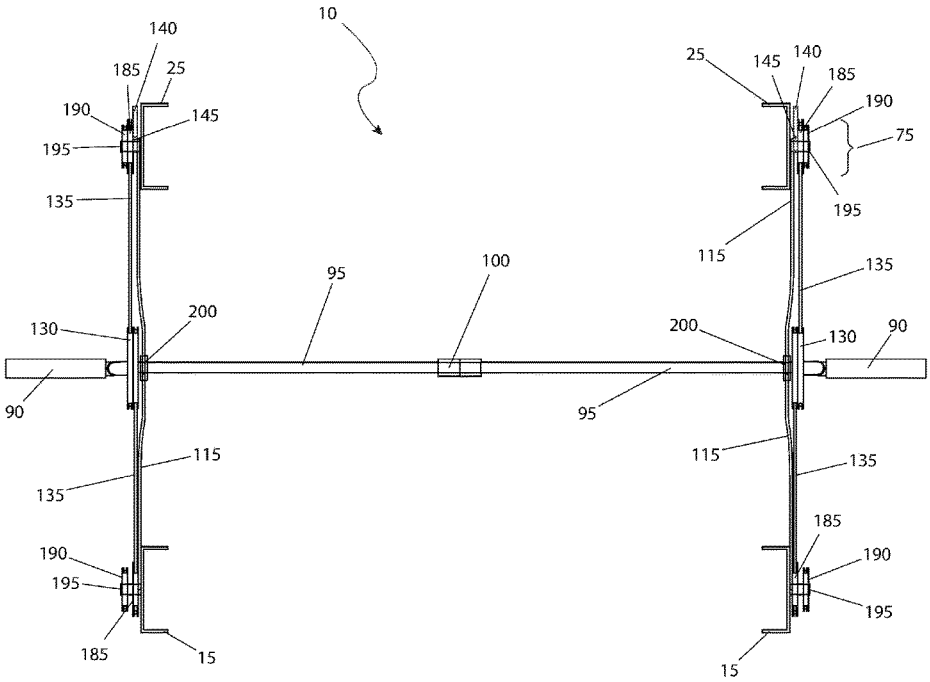
FIG. 5 is a sectional view of the stepladder 10, as seen along a line II-II, as shown in FIG. 3, according to the preferred embodiment of the present invention.

Referring to FIG. 5, a sectional view of the stepladder 10, as seen along a line II-II, as shown in FIG. 3, according to the preferred embodiment of the present invention. The front side rails 15 are shown on one side, with the rear side rails 25 on the other. An inner face of upper drive socket 185 and an outer face of upper drive socket 190, both of which are components of the upper drive sprocket 75, are mounted on a common shaft 195. The four (4) inner face of upper drive socket 185 are used to drive the lower drive sprockets 70 (as shown in FIG. 1) via the vertical drive chains 80 (as shown in FIG. 1). The four (4) outer face of upper drive socket 190 are connected to the respective dual main drive sprockets 130 via the four (4) horizontal drive chains 135. The bridging shaft 95, as connected via the slip coupling 100, is supported by a hinge bracket 200 on the folding brace 115, and thus allow for movement of the dual main drive sprockets 130 in an independent manner as aforementioned described via the crank handles 90 The brake mechanism 145 is shown engaging the inner face of upper drive socket 185 and the outer face of upper drive socket 190 on each of the front side rails 15, as manipulated by the brake levers 140.

2. Operation of the Preferred Embodiment

The preferred embodiment of the present invention can be utilized by the common user in a simple and effortless manner with little or no training. It is envisioned that the stepladder 10 would be constructed in general accordance with FIG. 1 through FIG. 5. The user would procure the stepladder 10 from conventional procurement channels such as hardware stores, home improvement stores, mechanical supply houses, mail order and internet supply houses and the like. Special attention would be paid to the overall size and height of the stepladder 10, along with materials of construction, weight ratings, and the like.

After procurement and prior to utilization, the stepladder 10 would be prepared in the following manner: the stepladder 10 would be carried to the location of use in the same manner as a conventional ladder. The front side rails 15 and the rear side rails 25 would be spread apart using the hinge points 125 on the top cap 30 and locked into place via the two (2) spreaders 35; if needed, the movable work surface 45 would be mounted onto the mounting holes 40 of the front side rails 15 using the spring loaded pins 50. The stepladder 10 would be placed in a secured position for mounting by ensuring that both brake mechanism 145 are engaged. It is also noted that with the brake mechanism 145 disengaged, the stepladder 10 may be rolled to the location of use and then secured by manipulation of the brake lever(s) 140 once there. At this point in time, the stepladder 10 is ready for use.

During utilization of the stepladder 10, the following procedure would be initiated: the user would climb the steps 20 of the stepladder 10 in a conventional ladder until the desired elevation is reached. The user may climb down and dismount the stepladder 10 at any time. Should the location of the stepladder 10 require movement and the user does not want to dismount the stepladder 10, said user may disengage the brake mechanism 145 by manipulation of the brake levers 140; next while grabbing a crank assembly 85 in each hand, and by turning both crank handles 90 forward in an equal manner, the stepladder 10 will move forward in a straight manner; by turning both crank handles 90 backward in an equal manner, the stepladder 10 will backwards in a straight manner; by turning only one (1) crank handle 90, the stepladder 10 will make a corresponding hard turn based upon which crank handle 90 the rotational force is imparted to; by turning each crank handles 90 in a differential manner, the stepladder 10 will make motion along corresponding differential arcing travel path "a" 160. Upon arriving at the desired location, the user would re-engage the brake mechanism 145. This usage cycle would continue for the balance of the tasks occurring at an elevated location.

After use of the stepladder 10, the movable work surface 45, if used, is removed by removal of the two (2) spring loaded pins 50; the spreaders 35 are unlocked, and the front side rails 15 and rear side rails 25 folded together for a reduced storage footprint. This usage cycle continues in a repetitive manner as required.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A stepladder, comprising:

a plurality of front side rails provided with a plurality of evenly spaced mounting holes along an outward facing surface which allow for mounting a movable work surface;

a pair of spreaders operated with a folding brace of a crank assembly to allow the front side rails and a plurality of rear side rails to fold together along a second travel path using a pair of hinge points in a top cap;

a pair of crank handles cranked to cause the stepladder to move forward or backward;

a bridging shaft having a center-mounted slip coupling common to both sides of the crank assembly to allow the crank handles to be rotated independently so the stepladder is moved in a circle to allow the stepladder to move in an arced travel path as well as a linear travel path;

a bridging shaft common to both sides of the crank assembly provided with a center-mounted slip coupling that allows the crank handles to be rotated independently and a set of two horizontal drive chains;

a pair of brake levers provided to engage a plurality of upper drive sprockets and prevent rotation;

a brake mechanism creating friction against the upper drive sprockets when the brake lever is moved along a third travel path; and an axle pin driven through one side of a mounting bracket into a wheel bearing of a wheel, into another wheel bearing, through an opposite side of the mounting bracket, into a sprocket bearing and finally into a plurality of lower drive sprockets;

wherein the lower drive sprockets are connected to the respective upper drive sprockets by a vertical drive chain;

wherein a first crank handle of the pair of crank handles cranks clockwise and a second crank handle of the pair of crank handles counterclockwise;

wherein the crank handles include a 90° coupling to allow the crank handles to fold along a first travel path for space saving ability; and wherein a rotational force imparted to the crank handles by the user is transferred to the upper drive sprockets by the horizontal drive chains, then to the lower drive sprockets of each roller assemblies by the vertical drive chains.

2. The stepladder according to claim 1, wherein the roller assembly includes a wheel, the mounting bracket, and one of the lower drive sprockets.

3. The stepladder according to claim 1, wherein the crank assembly provides a plurality of dual main drive sprockets.

4. The stepladder according to claim 1, wherein by manipulation of the crank handles on either side of the stepladder, along a crank travel path, the user affects motion of the stepladder.

5. The stepladder according to claim 1, wherein by turning both of the crank handles forward in an equal manner, the stepladder moves forward in a straight manner.

6. The stepladder according to claim 1, wherein by turning both of the crank handles backward in an equal manner, the stepladder will move backwards in a straight manner.

7. The stepladder according to claim 1, wherein by turning only one of the crank handles, the stepladder will make a corresponding hard turn based upon which crank handle the rotational force is imparted to.

8. The stepladder according to claim 1, wherein by turning each of the crank handles in a differential manner, the stepladder will make motion along corresponding differential arcing travel path.

9. The stepladder according to claim 1, wherein the axle pin is held in place by a restraining means selected from the group consisting of a cap, a nut, or a forged dome.

10. The stepladder according to claim 1, wherein the stepladder is made of material selected from the group consisting of wood, aluminum, or fiberglass.

* * * * *